US006508278B1

(12) United States Patent
Kornett

(10) Patent No.: US 6,508,278 B1
(45) Date of Patent: Jan. 21, 2003

(54) SEAM ENHANCEMENTS FOR SEAMED PAPERMAKER'S FABRICS

(75) Inventor: Glenn J. Kornett, Bonneau Beach, SC (US)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 09/990,319

(22) Filed: Nov. 23, 2001

(51) Int. Cl.[7] ..... D03D 23/00; D03D 15/00

(52) U.S. Cl. ..... 139/383 A; 139/383 A; 139/383 R; 139/415

(58) Field of Search ..... 139/383 AA, 383 R, 139/408, 409, 415, 383 A, DIG. 1

(56) References Cited

U.S. PATENT DOCUMENTS

| | | | | |
|---|---|---|---|---|
| 3,815,645 A | | 6/1974 | Codorniu | |
| 5,005,610 A | | 4/1991 | Davenport | |
| 5,204,150 A | | 4/1993 | Davenport | |
| 5,391,419 A | | 2/1995 | Davenport | |
| 5,476,123 A | | 12/1995 | Rydin | |
| 5,531,251 A | | 7/1996 | Rydin | |
| 5,732,749 A | * | 3/1998 | Fargeout | 139/383 A |
| 5,799,709 A | * | 9/1998 | Shipley | 139/383 AA |
| 5,913,339 A | | 6/1999 | Lee | |
| 6,273,146 B1 | * | 8/2001 | Herring | 139/383 AA |
| 6,289,940 B1 | * | 9/2001 | Herring | 139/383 AA |
| 6,318,413 B1 | * | 11/2001 | Herring | 139/383 AA |

* cited by examiner

*Primary Examiner*—John J. Calvert
*Assistant Examiner*—Robert H. Muromoto, Jr.
(74) *Attorney, Agent, or Firm*—Frommer Lawrence & Haug LLP; Ronald R. Santucci

(57) ABSTRACT

An on-machine-seamable papermaker's fabric produced by modified endless weaving includes machine-direction (MD) and first cross-machine-direction (CD) yarns. The MD yarns weave continuously back and forth between the two widthwise edges of the fabric, each time forming a seaming loop at one of the two widthwise edges. The MD and first CD yarns are interwoven with one another in a first weave pattern. The fabric also includes systems of second and third CD yarns. The second CD yarns are interwoven with the MD yarns along one of the two widthwise edges of the fabric between the system of first CD yarns and the seaming loops in a second weave pattern which may be different from the first weave pattern. Likewise, the third CD yarns are interwoven with the MD yarns along the other of the two widthwise edges of the fabric between the system of first CD yarns and the seaming loops in a third weave pattern which may be different from the first weave pattern. The second and third weave patterns may be the same as or different from one another. The second and third CD yarns may make the compressibility and permeability characteristics of the seam regions like those of the rest of the fabric, or may improve the stability, uniformity and orientation of the seaming loops at the two ends of the fabric.

62 Claims, 4 Drawing Sheets

SEAM ENHANCEMENTS FOR SEAMED PAPERMAKER'S FABRICS

BACKGROUND OF THE INVENTION

1. Field of the Invention

The present invention relates to the papermaking arts. More specifically, the present invention is a papermaker's fabric of the on-machine-seamable variety, such as an on-machine-seamable press fabric for the press section of a paper machine.

2. Description of the Prior Art

During the papermaking process, a fibrous web is formed by depositing a fibrous slurry, that is, an aqueous dispersion of cellulose fibers, onto a moving forming fabric in the forming section of a paper machine. A large amount of water is drained from the slurry through the forming fabric during this process, leaving the fibrous web on the surface of the forming fabric.

The newly formed web proceeds from the forming section to a press section, which includes a series of press nips. The fibrous web passes through the press nips supported by a press fabric, or, as is often the case, between two press fabrics. In the press nips, the fibrous web is subjected to compressive forces which squeeze water therefrom, and which adhere the fibers in the web to one another to turn the fibrous web into a sheet. The water is accepted by the press fabric or fabrics and, ideally, does not return to the web.

The web finally proceeds to a dryer section, which includes at least one series of rotatable dryer drums or cylinders, which are internally heated by steam. The web, or newly formed paper sheet, itself is directed in a serpentine path sequentially around each in the series of drums by a dryer fabric, which holds the web closely against the surfaces of the drums. The heated drums reduce the water content of the web to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speed. That is to say, the fibrous slurry is continuously deposited onto the forming fabric in the forming section, while a newly manufactured paper sheet is continuously wound onto rolls after it exits from the dryer section.

Referring, for the moment, specifically to press fabrics, it should be recalled that, at one time, press fabrics were supplied only in endless form. This is because a newly formed paper sheet is extremely susceptible to marking in the press nip by any nonuniformity in the press fabric or fabrics. An endless, seamless fabric, such as one produced by the process known as endless weaving, has a uniform structure in both its longitudinal (machine) and transverse (cross-machine) directions. A seam, such as a seam which may be used to close the press fabric into endless form during installation on a paper machine, represents a discontinuity in the uniform structure of the press fabric. The use of a seam, then, greatly increases the likelihood that the paper sheet will be marked in the press nip.

In brief, the seam region of any workable on-machine-seamable, or OMS®, press fabric must behave under load, that is, under compression in the press nip or nips, like the rest of the press fabric, and must have the same permeability to water and to air as the rest of the press fabric, in order to prevent the paper product being manufactured from being marked by the seam region. OMS is a registered trademark of Albany International Corp.

Despite the considerable technical obstacles presented by these requirements, it remained highly desirable to develop an on-machine-seamable press fabric, because of the comparative ease and safety with which it could be installed on a press section. Ultimately, these obstacles were overcome with the development of press fabrics having seams formed by providing seaming loops on the crosswise edges of the two ends of the fabric. Then seaming loops themselves are formed by the machine-direction (MD) yarns of the fabric. A seam is formed by bringing the two ends of the press fabric together, by interdigitating the seaming loops at the two ends of the fabric, and by directing a so-called pin, or pintle, through the passage defined by the interdigitated seaming loops to lock the two ends of the fabric together. Needless to say, it is much easier and far less timeconsuming to install an on-machine-seamable press fabric, than it is to install an endless press fabric, on a paper machine.

There are several methods for producing a press fabric that can be joined into endless form on the paper machine with such a seam. One method is to flat-weave the fabric, in which case the warp yarns are the machine-direction (MD) yarns of the press fabric. To form the seaming loops, the warp ends are woven some distance back into the fabric body in a direction parallel to the warp yarns. Another technique, far more preferable, is a modified form of endless weaving, which normally is used to produce an endless loop of fabric. In modified endless weaving, the weft, or filling, yarns are continuously woven back and forth across the loom, in each passage forming a loop on one of the edges of the fabric being woven by passing around a loop-forming pin. As the weft yarn, or filling yarn, which ultimately becomes the MD yarn in the press fabric, is continuous, the seaming loops obtained in this manner are stronger than any that can be produced by weaving the warp ends back into the ends of a flat-woven fabric.

Originally, single monofilament strands were used in both the machine and cross-machine directions of on-machine-seamable press fabrics. The relative stiffness of monofilament ensures that it will have the requisite good seaming-loop formation properties. Experience showed, however, that single monofilament strands are difficult to weave and have insufficient elasticity in the machine direction for many kinds of contemporary presses. Tensile failure and seam breakage were frequently observed.

Another difficulty is presented by the very open, rigid, incompressible structure of base fabrics woven from single monofilament. For some papermaking applications, this incompressibility is not a problem, and may even be ideal. However, for positions that have poor auxiliary fabric dewatering capacity, or produce mark-sensitive paper grades, a softer, more compressible base fabric is needed.

A more compressible base fabric may be obtained by weaving with multifilament or plied monofilament yarns, instead of with single monofilament strands. However, yarns of these types do not have the rigidity necessary for good loop formation or for maintaining the integrity of the seam area during loop meshing when the seam is to be closed. Moreover, because yarns of these types are twisted, loops formed from them tend to rotate about axes lying in the planes of the loops. When this rotation, known as the secondary helix effect, occurs, it causes the loops to depart from the ideal orientation needed to form the seam, that orientation being such that the planes of the loops are parallel to one another, align with the machine direction, and are perpendicular to the plane of the base fabric, and that the loops themselves align widthwise across the base fabric. Departure from this ideal orientation makes it difficult, if not impossible, to interdigitate the loops at each end of the press fabric properly during closure, as well as to direct a pintle through the passage defined by the interdigitated loops.

Various attempts have been made in the prior art to overcome these difficulties by making the loop-forming MD yarns act like monofilament, although, as will become apparent below, loops formed by monofilament yarns are not necessarily free of orientation and alignment problems. In U.S. Pat. No. 5,005,610, the MD yarns in an on-machine-seamable papermaker's fabric have a composite structure including braided monofilament strands. The braided yarn forms seaming loops which resist deformation and, because they are balanced with regard to twist, form seaming loops which are not susceptible to "secondary helix effect" rotation from a preferred orientation.

In U.S. Pat. No. 5,204,150, the MD yarns in an on-machine-seamable papermaker's fabric are plied/twisted yarns extruded from a resin which partially melts during the heat-setting of the fabric, giving the MD yarns a monofilament-like character. Even though not balanced due to the twisting and plying, the fusion caused by the partial melting of the individual ends prevents loop rotation from a preferred orientation.

Finally, in U.S. Pat. No. 5,391,419, the MD yarns of an on-machine-seamable papermaker's fabric are plied/twisted yarns having a coating which gives them yarn a monofilament-like structure. The coating may be either permanent, semi-permanent or soluble. Even though the yarns may not be balanced, the coating prevents loop rotation.

Another approach toward improved seaming loop uniformity and stability, useful no matter what the form of the MD yarns, is shown in U.S. Pat. No. 5,913,339. This patent shows an on-machine-seamable papermaker's fabric having first and second layers of machine-direction (MD) yarns interwoven with a plurality of cross-machine-direction (CD) yarns. The fabric is woven in a modified endless weave in which seaming loops are formed by the MD yarns when they alternate between the first and second layers at the ends of the fabric. Additional CD yarns are interwoven with both MD layers at each end of the fabric between the last CD yarn and the seaming loops in a balanced weave which establishes vertical and horizontal alignment for the seaming loops. More specifically, the additional CD yarns correct for any misalignment of the seaming loops arising from the pattern in which the fabric is woven, rather than from the character of the yarns themselves.

While it is important to maintain the uniformity, alignment and proper orientation of the seaming loops, a more important technical challenge with on-machine-seamable press fabrics is presented by desirability of providing the seam and regions immediately adjacent thereto with permeability and compressibility characteristics substantially identical to those of the rest of the press fabric, or, in other words, the body of the press fabric. In connection with this technical challenge, which relates to the minimization of any marking of the paper sheet by the seam region, it should be recalled that the manufacture of an on-machine-seamable press fabric includes the attachment of a staple fiber batt to one or both, sides thereof. The attachment may be effected by a process called needling (fiber locking) or by hydroentangling, while the on-machine-seamable base fabric is in endless form. Once the desired amount of staple fiber batt has been attached, the loop-forming pin or pintle is removed to place the press fabric into flat, or open, form for shipment and eventual installation on a paper machine. At that time, the staple fiber batt must be cut in the vicinity of the seam to completely separate the two ends of the press fabric from one another. Typically, the staple fiber batt is cut in a manner that enables it to form a flap over the seaming loops when the press fabric is rejoined into endless form during installation on a paper machine. For this reason, the two ends of the press fabric are often referred to as the "flap" end, which has the flap of staple fiber material extending over and beyond the seaming loops, and the "no-flap" end, which has a space, adjacent to its seaming loops, into which the flap on the other end fits when the fabric is joined into endless form. It should be noted that, when the fabric is installed on a paper machine, its orientation is such that the "flap" end will lead the "no-flap" end through the press nip or nips to prevent the flap from wearing away too quickly.

On the other side, the so-called "roll" side, of the press fabric, some staple fiber batt may be removed from the seaming loops to facilitate subsequent passage of a pintle therethrough. The removal of this generally small amount of staple fiber batt makes the seam region slightly more permeable to air and water than the body of the press fabric. This difference in permeability or flow resistance, perhaps ever so slight, is sufficient to cause sheet marking in some situations.

Several approaches toward solving this problem have heretofore been taken. One approach involves the use of stuffer yarns with the pintle when the press fabric is being joined into endless form on the paper machine. In another approach, a press fabric comprises two on-machine-seamable base fabrics, one fitting inside the endless loop formed by the other, the two base fabrics being laminated to one another during the needling process. The seam regions of the inner and outer base fabrics are offset slightly with respect to one another, so that the seam region of each will coincide with a non-seam region of the other. Once the desired amount of staple fiber batt has been attached to the inner and/or outer surfaces of the laminated base fabrics, the loop-forming pin or pintle of each on-machine-seamable base fabric is removed to place the on-machine-seamable press fabric into flat form for shipment and eventual installation on a paper machine. At that time, the staple fiber batt must be cut in the vicinity of the seam in the outer of the two on-machine-seamable base fabrics to completely separate the two ends of the press fabric from one another. As above, the staple fiber batt may be cut in a manner that enables it to form a flap over the seaming loops when the press fabric is rejoined into endless form. Some of the staple fiber batt may also be removed from the seaming loops of both the inner and outer on-machine-seamable base fabrics to facilitate the subsequent passage of pintles therethrough.

In yet another approach, disclosed in U.S. Pat. Nos. 5,476,123 and 5,531,251 to Rydin, one or more extra CD yarns are woven with the seaming loops of at least one end of a base fabric of an on-machine-seamable press fabric. The extra yarn or yarns are woven only with those portions of the seaming loops that are on one side of the fabric, that side preferably being the paper-supporting side. The extra CD yarn or yarns form an extension of the CD yarn system of the base fabric at the seaming loop or loops, conforming the seam region more closely to the rest of the base fabric, so that staple fiber batt will be better anchored to the seam region and so that the possibility of sheet marking by the seam region will be minimized.

The present invention provides another approach toward providing the seam region of an on-machine-seamable press fabric with permeability and compressibility characteristics substantially identical to those of the body of the press fabric in order to minimize the marking of a paper sheet by the seam region. It also may serve as a means for maintaining the uniformity, alignment and proper orientation of the seaming loops.

SUMMARY OF THE INVENTION

Accordingly, the objective of the present invention is to provide an on-machine-seamable papermaker's fabric with seam regions having compressibility and permeability characteristics like those of the body of the fabric. This objective is met with the present on-machine-seamable papermaker's fabric, which is preferably woven in a modified endless weaving technique from a system of machine-direction (MD) yarns and a system of first cross-machine-direction (CD) yarns. The papermaker's fabric has a rectangular shape with a length, a width, two lengthwise edges and two widthwise edges. The yarns of the system of MD yarns are interwoven with the yarns of the system of first CD yarns in a first weave pattern, and form the body of the fabric.

The MD yarns extend back and forth continuously for the length of the papermaker's fabric between the two widthwise edges, at each widthwise edge forming a plurality of seaming loops.

The papermaker's fabric also includes a system of second CD yarns, which are interwoven with the yarns of the system of MD yarns in a first region along one of the two widthwise edges of the papermaker's fabric between the system of first CD yarns and the seaming loops. The second CD yarns are woven with the MD yarns in a second weave pattern which may be the same as or different from the first weave pattern. The first region includes more than two second CD yarns, and differs from the body by at least one of the following:

a) the denier of at least some of the second CD yarns is different from the denier of the first CD yarns;

b) the spacing between at least some of the second CD yarns is different from the spacing between the first CD yarns; and c) the second weave pattern is different from the first weave pattern.

The papermaker's fabric further includes a system of third CD yarns, which are interwoven with the yarns of the system of MD yarns in a second region along the other of the two widthwise edges of the papermaker's fabric between the system of first CD yarns and the seaming loops. The third CD yarns are woven with the MD yarns in a third weave pattern which may be the same as or different from the first weave pattern. The second region includes more than two third CD yarns, and differs from the body by at least one of the following:

a) the denier of at least some of the third CD yarns is different from the denier of the first CD yarns;

b) the spacing between at least some of the third CD yarns is different from the spacing between the first CD yarns; and c) the third weave pattern is different from the first weave pattern.

The present invention will now be described in more complete detail, with reference being made to the figures identified below.

DETAILED DESCRIPTION OF THE PREFERRED EMBODIMENTS

Figure 1:
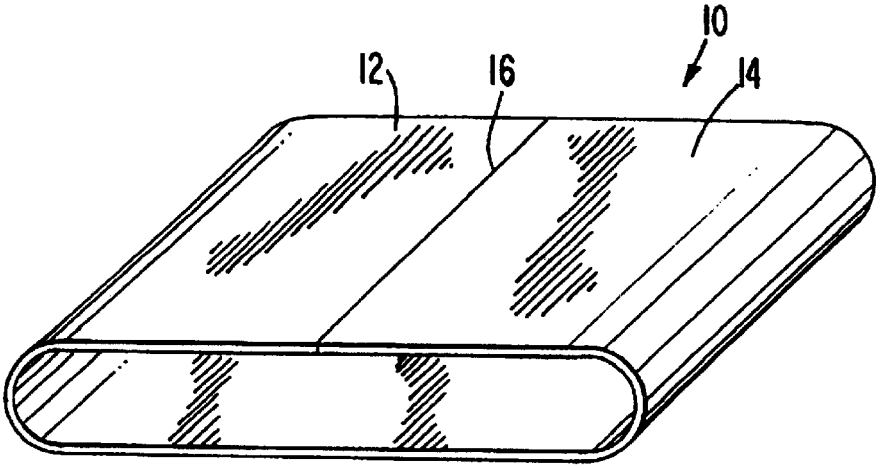
FIG. 1 is a schematic perspective view of an on-machine-seamable papermaker's fabric of the present invention.

Turning now specifically to the figures, FIG. 1 is a schematic perspective view of an on-machine-seamable papermaker's fabric 10 of the present invention. The fabric 10 takes the form of an endless loop once its two ends 12,14 have been joined to one another at seam 16.

Figure 2:
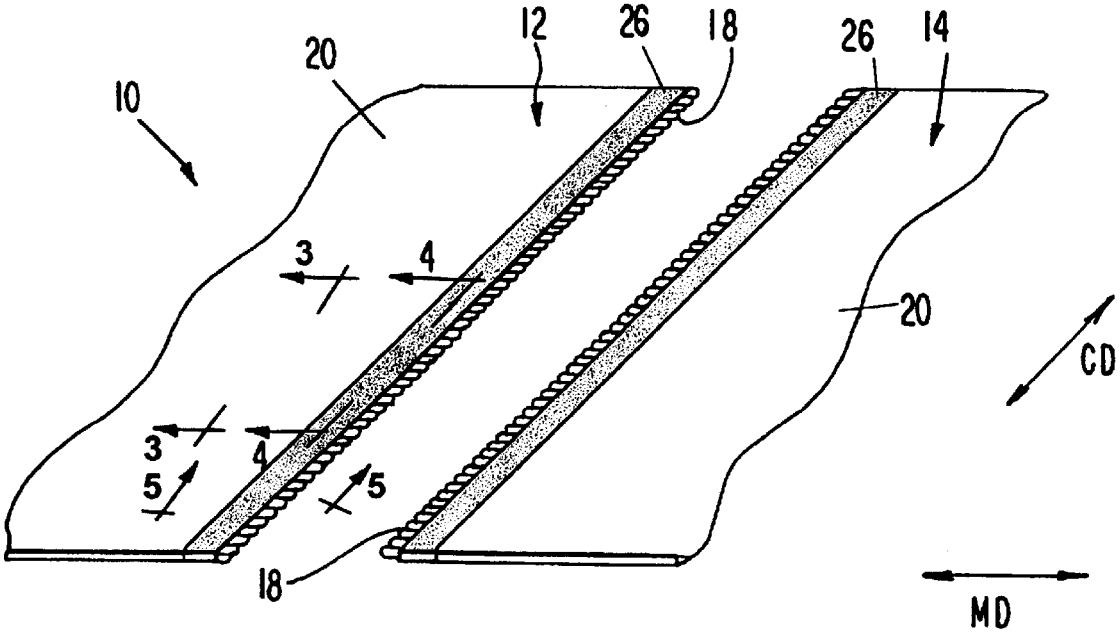
FIG. 2 is a schematic perspective view of the two ends of the on-machine-seamable papermaker's fabric prior to their attachment to one another.

FIG. 2 is a schematic perspective view of the two ends 12,14 of the on-machine-seamable fabric 10 prior to their attachment to one another. Disposed widthwise along the edges of each of the two ends 12,14 are a plurality of seaming loops 18. To attach the two ends 12,14 of the fabric 10 to one another, one brings them together, in so doing alternating and intermeshing, or interdigitating, the seaming loops 18 at one end 12 with those at the other end 14. The interdigitated seaming loops 18 define a passage through which a pin, or pintle, a yarn-like strand or member, may be directed to secure the ends 12,14 to one another.

Figure 3:
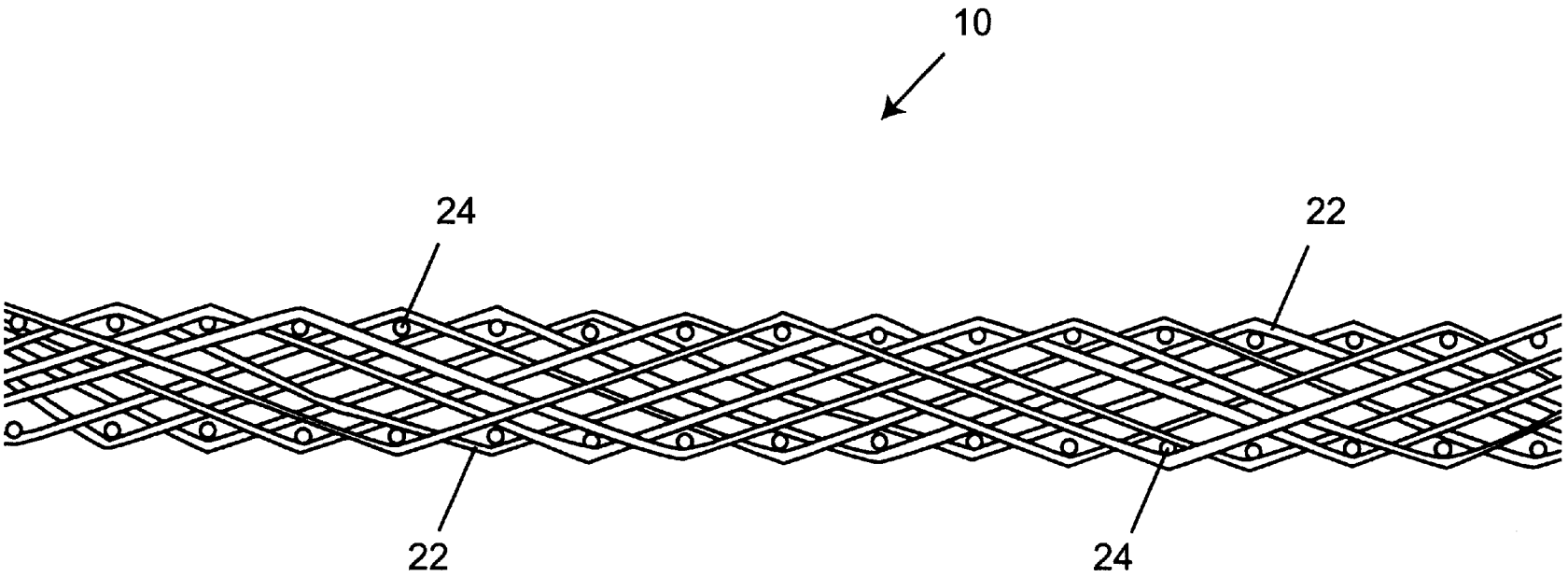
FIG. 3 is a cross-sectional view taken as indicated by line 3—3 in FIG. 2.

FIG. 3 is a cross-sectional view, taken as indicated by line 3—3 in FIG. 2, of papermaker's fabric 10. Fabric 10, or, more specifically, the body 20 of the fabric 10 is shown to be woven in an 8-shed duplex weave, although it should be understood that such a weave is shown as an example only, and that the present invention could be practiced with fabrics 10 that are woven in any other weave, including duplex, triplex and other multilayer weaves, except as noted below, and is not limited in any way to the particular weave shown in FIG. 3. Fabric 10, as the base fabric for a press fabric, may be needled with one or more layers of staple fiber batt material on one or both sides, or may be coated in some manner. Alternatively, fabric 10 may be used on one of the other sections of the paper machine, that is, on the forming or drying sections, or as a base for a polymeric-resin-coated, paper-industry process belt.

Fabric 10 is preferably woven in a modified endless weaving process. In such a situation, warp yarns 22 ultimately become the cross-machine-direction (CD) yarns of the fabric 10, and the weft yarns 24 ultimately become its machine-direction (MD) yarns, when reference is made to the orientations of the yarns relative to the paper machine on which the fabric 10 is installed.

Warp yarns 22 and weft yarns 24, the CD and MD yarns of the on-machine-seamable fabric 10, respectively, may be yarns of any of the varieties used by those of ordinary skill in the art to weave paper machine clothing. That is to say, monofilament yarns, which are monofilament strands used singly, multifilament yarns, or plied/twisted yarns, in the form of plied monofilament or plied multifilament yarns, or yarns of any of the other varieties of yarn used by those of ordinary skill in the art to weave paper machine clothing, may be used as warp yarns 22 and weft yarns 24. Moreover, warp yarns 22 and weft yarns 24 may be extruded, or otherwise produced, from any of the polymeric resin materials commonly used by those of ordinary skill in the art for producing yarns for use in paper machine clothing.

Figure 4:
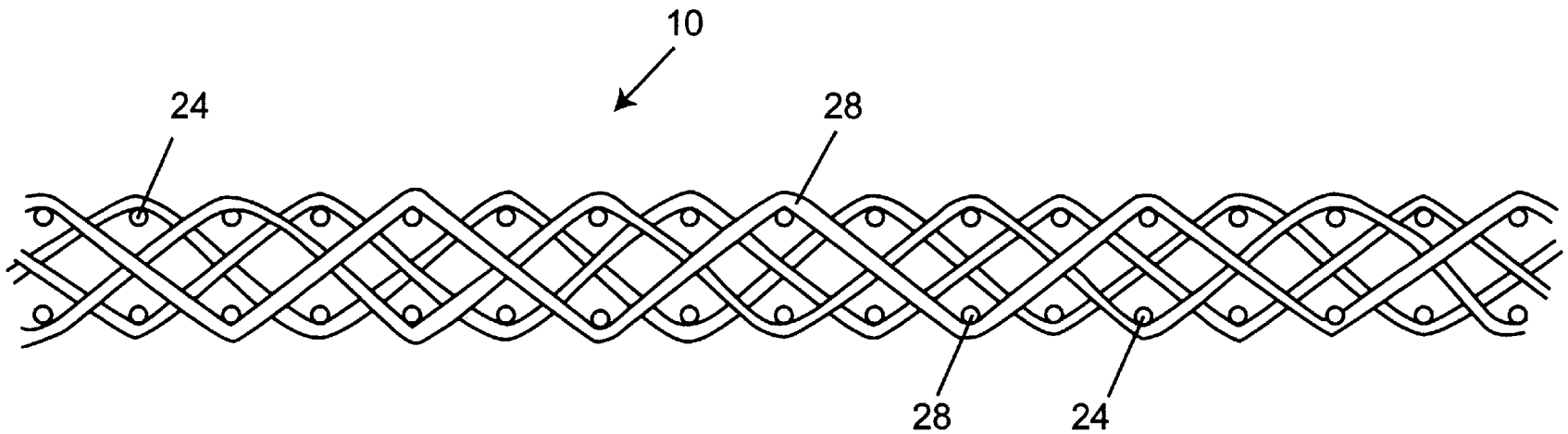
FIG. 4 is a cross-sectional view taken as indicated by line 4—4 in FIG. 2.

Referring again to FIG. 2, extending widthwise across the fabric 10 adjacent to seaming loops 18 at its ends 12,14 are regions 26 which are short relative to the length of the fabric 10 as a whole. FIG. 4 is a cross-sectional view taken as indicated by line 4—4 in FIG. 2. In regions 26, fabric 10 may, as illustrated in FIG. 4, be woven in a 4-shed duplex weave, which, in addition to compensating for differences in permeability and compressibility between regions 26 and body 20, tends to maintain weft yarns 24 in a vertically stacked condition. Specifically, in regions 26, as shown in FIG. 4, weft yarns 24 are interwoven in the 4-shed duplex weave with warp yarns 28. Such a weave is commonly used to maintain yarns, such as weft yarns 24, in a vertically stacked condition, and is used here to give seaming loops 18, which are formed by weft yarns 24, a desired uniformity, stability and orientation perpendicular to the plane of the fabric.

More generally, regions 26 of fabric 10 may be woven in any weave pattern different from that used in weaving the body 20 of the fabric 10 to compensate for differences in permeability and compressibility which would otherwise be present if the entire fabric 10 were woven in the same pattern, or regions 26 may be woven in the same weave pattern as that used in weaving the body 20 of the fabric 10 to accomplish the same object if the denier of or spacing between at least some of the warp yarns 28 is different from that of warp yarns 22.

Further, recalling the discussion above on the distinction between the "flap" end and the "no-flap" end of an on-machine-seamable press fabric, it may be necessary or desirable to weave region 26 on the "flap" end in one weave pattern, while weaving region 26 on the "no-flap" end in a different weave pattern, both weave patterns being different from that used to weave the body 20 of the fabric 10. Here, the object would again be to compensate for differences in permeability and compressibility among the two regions 26 and the body 20 which would otherwise be present if the entire fabric 10 were woven in the same pattern. Moreover, where regions 26 are woven in the same weave pattern as that used in weaving the body 20 of the fabric 10, the denier of or spacing between at least some of the warp yarns 28 is different from that of warp yarns 22 in the two regions 26 of the fabric 10 to accomplish the same object.

Like warp yarns 22 and weft yarns 24, warp yarns 28 in regions 26 may also be yarns of any of the varieties, previously identified above, which are used by those of ordinary skill in the art to weave paper machine clothing.

Warp (CD) yarns 22 and warp (CD) yarns 28, however, need not be the same as one another. That is to say, warp yarns 22 may be yarns of one of the varieties, previously identified above, which are used by those of ordinary skill in the art to weave paper machine clothing, while warp yarns 28 may be of another. Moreover, warp yarns 28 may be shaped yarns, that is, yarns of non-circular cross section, such as yarns of rectangular, oval or elliptical cross section. Warp yarns 28 may be extruded, or otherwise produced, from any of the polymeric resin materials commonly used by those of ordinary skill in the art for producing yarns for use in paper machine clothing. The polymeric resin material used in the production of warp yarns 28 may be the same as or different from that used to produce warp yarns 22.

Further, warp yarns 28 in one region 26 may be yarns of a variety different from the warp yarns 28 of the other region 26. Moreover, warp yarns 28 may be of either larger or smaller denier than warp yarns 22, or may be of a spacing or count different from that of warp yarns 22, or, in other words, may weave in a different density with weft yarns 24. In these respects, too, the denier of the warp yarns 28 and their spacing or count may be different in one region 26 relative to the other region 26, depending on the permeability and compressibility characteristics desired for regions 26 relative to those desired for the body 20 of the fabric 10.

Alternatively, in a technique that may be referred to as "feathering", the denier of the warp yarns 28 in the regions 26 may either increase or decrease in increments from the denier of the warp yarns 22 in the body 20 between the body 20 and the seaming loops 18. In this alternative, the "feathering" may be done in one or both of the regions 26, and, if done in both, the denier of the warp yarns 28 may increase in one region 26 while it decreases in the other region 26. Moreover, the "feathering" may be done by pairs of warp yarns 28, such that the denier of adjacent pairs of warp yarns 28 increases or decreases in increments, or by complete repeats of the weave pattern by which the warp yarns 28 weave with the weft yarns 24, such that the denier of the warp yarns in each repeat increases or decreases in increments. Further, the "feathering" may be done with respect to the spacing between adjacent warp yarns 28, between pairs of warp yarns 28 or between complete repeats of the weave pattern by which warp yarns 28 weave with weft yarns 24 in a manner analogous to that in which the denier of the warp yarns 28 may be changed. "Feathering" can be used to gradually change the rate of acceleration of the water through the fabric to minimize hydraulic marking from the seam.

Figure 5:
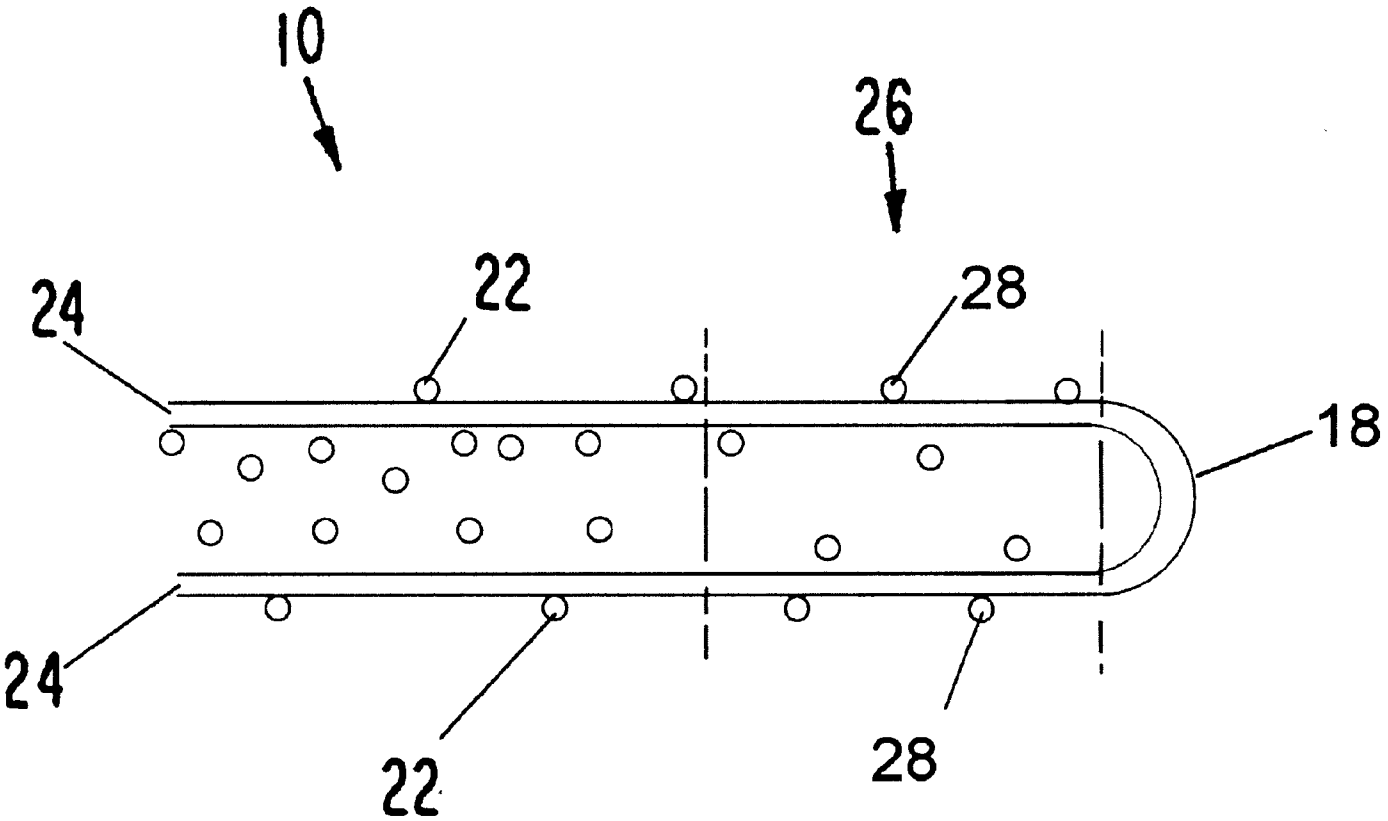
FIG. 5 is a cross-sectional view taken as indicated by line 5—5 in FIG. 2.

FIG. 5 is a cross-sectional view taken as indicated by line 5—5 in FIG. 2. Weft yarns 24, which are the MD yarns in fabric 10, form seaming loops 18. Region 26, which lies between the two vertical dashed lines in FIG. 5, includes two pattern repeats of the 4-shed duplex pattern by which warp yarns 28 are woven with weft yarns 24. In general, however, it is within the intended scope of the present invention that region 26 contain more than two warp yarns 28, or, preferably, from one to eight repeats of the weave pattern in which warp yarns 28 weave with weft yarns 24. In FIG. 5, warp yarns 28, woven with weft yarns 24 in a 4-shed duplex pattern, maintain weft yarns 24 in a vertically stacked condition, improve the uniformity and alignment of the seaming loops formed by weft yarns 24, and ensure that the orientation of the seaming loops 18 remains perpendicular to the plane of fabric 10, all of which facilitates their interdigitation when the ends 12,14 of the fabric 10 are to be joined to one another to place it into endless form. Where "feathering" is used, the denier of, or spacing between, warp yarns 28 would increase or decrease incrementally from that of warp yarns 22 from left to right within region 26 in FIG. 5, as described above.

The filaments comprising warp (CD) yarns 22, weft (MD) yarns 24 and warp (CD) yarns 28 are extruded from polymeric resin materials, such as polyamide, polyester, polyetherketone, polypropylene, polyaramid, polyolefin and polyethylene terephthalate (PET) resins, and incorporated into yarns according to techniques wellknown in the textile industry and particularly in the paper machine clothing industry.

In the weaving of fabric 10 by modified endless weaving, the weft yarns 24 are continuously woven back and forth across the loom, in each passage thereacross forming a loop on one of the edges of the fabric 10 being woven by passing around a loop-forming pin. Several schemes, disclosed and claimed in U.S. Pat. No. 3,815,645 to Codorniu, the teachings of which are incorporated herein by reference, for weaving on-machine-seamable fabrics by modified endless weaving are available and may be used in the practice of the present invention. It should be understood, however that it is within the scope of the present invention to flat weave fabric 10 and to form seaming loops, subsequently, by turning warp yarns extending beyond the ends of the fabric 10 back to form seaming loops, and by weaving the turned-back ends into the fabric.

Modifications to the above would be obvious to those of ordinary skill in the art, but would not bring the invention so modified beyond the scope of the appended claims.

What is claimed is:

1. An on-machine-seamable papermaker's fabric comprising:

a system of machine-direction (MD) yarns and a system of first cross-machine-direction (CD) yarns, said yarns of said system of MD yarns being interwoven with said yarns of said system of first CD yarns in a first weave pattern to form a body of said papermaker's fabric in a rectangular shape with a length, a width, two lengthwise edges and two widthwise edges, said MD yarns extending back and fourth continuously for said length of said papermaker's fabric between said two widthwise edges, said MD yarns further forming seaming loops along each of said two widthwise edges;

a system of second CD yarns, said yarns of said system of second CD yarns being interwoven with said yarns of said system of MD yarns in a first region along one of said two widthwise edges of said papermaker's fabric between said system of first CD yarns and said seaming loops in a second weave pattern, there being more than two second CD yarns in said system of second CD yarns, wherein said first region differs from said body by at least one of the following:

a) the denier of at least some of said second CD yarn is different from the denier of said first CD yarns;

b) the spacing between at least some of said second CD yarns is different from the spacing between said first CD yarns; and c) said second weave pattern is different from said first weave pattern;

a system of third CD yarns being interwoven with said yarns of said system of MD yarns in a second region along the other of said two widthwise edges of said papermaker's fabric between said system of first CD yarns and said seaming loops in a third weave pattern, there being more than two third CD yarns in said system of third CD yarns, wherein said second region differs from said body by at least one of the following:

a) the denier of at least some of said third CD yarns is different from the denier of said first CD yarns;

b) the spacing between at least some of said third CD yarns is different from the spacing between said first CD yarns; and c) said third weave pattern is different from said first weave pattern.

2. An on-machine-seamable papermaker's fabric as claimed in claim 1 wherein said first weave pattern is selected from a group consisting of duplex, triplex and multi-layer weaves.

3. An on-machine-seamable papermaker's fabric as claimed in claim 1 wherein said first weave pattern is an 8-shed duplex weave pattern.

4. An on-machine-seamable papermaker's fabric as claimed in claim 1 wherein said system of second CD yarns in said first region along one of said two widthwise edges includes between one and eight repeats of said second weave pattern.

5. An on-machine-seamable papermaker's fabric as claimed in claim 1 wherein said system of third CD yarns in said second region along the other of said two widthwise edges includes between one and eight repeats of said third weave pattern.

6. An on-machine-seamable papermaker's fabric as claimed in claim 1 wherein said first weave pattern and said second weave pattern are the same weave pattern.

7. An on-machine-seamable papermaker's fabric as claimed in claim 1 wherein said first weave pattern and said third weave pattern are the same weave pattern.

8. An on-machine-seamable papermaker's fabric as claimed in claim 1 wherein said second weave pattern is a weave pattern different from said third weave pattern.

9. An on-machine-seamable papermaker's fabric as claimed in claim 1 wherein said second weave pattern and said third weave pattern are the same weave pattern.

10. An on-machine-seamable papermaker's fabric as claimed in claim 1 wherein said first weave pattern is a duplex weave pattern wherein said system of MD yarns comprises first and second layers of MD yarns.

11. An on-machine-seamable papermaker's fabric as claimed in claim 1 wherein said second weave pattern is a 4-shed duplex weave pattern.

12. An on-machine-seamable papermaker's fabric as claimed in claim 1 wherein said third weave pattern is a 4-shed duplex weave pattern.

13. An on-machine-seamable papermaker's fabric as claimed in claim 1 wherein said MD yarns are of a variety of yarn selected from the group consisting of monofilament yarns, multifilament yarns, and plied/twisted yarns in the form of plied monofilament or plied multifilament yarns.

14. An on-machine-seamable papermaker's fabric as claimed in claim 1 wherein said MD yarns include filaments extruded from a polymeric resin material.

15. An on-machine-seamable papermaker's fabric as claimed in claim 14 wherein said polymeric resin material is selected from the group consisting of polyamide, polyester, polyetherketone, polypropylene, polyaramid, polyolefin and polyethylene terephthalate (PET) resins.

16. An on-machine-seamable papermaker's fabric as claimed in claim 1 wherein said first CD yarns are of a variety of yarn selected from the group consisting of monofilament yarns, multifilament yarns, and plied/twisted yarns in the form of plied monofilament or plied multifilament yarns.

17. An on-machine-seamable papermaker's fabric as claimed in claim 1 wherein said first CD yarns include filaments extruded from a polymeric resin material.

18. An on-machine-seamable papermaker's fabric as claimed in claim 17 wherein said polymeric resin material is selected from the group consisting of polyamide, polyester, polyetherketone, polypropylene, polyaramid, polyolefin and polyethylene terephthalate (PET) resins.

19. An on-machine-seamable papermaker's fabric as claimed in claim 1 wherein said second CD yarns are of a variety of yarn selected from the group consisting of monofilament yarns, multifilament yarns, and plied/twisted yarns in the form of plied monofilament or plied multifilament yarns.

20. An on-machine-seamable papermaker's fabric as claimed in claim 1 wherein said second CD yarns include filaments extruded from a polymeric resin material.

21. An on-machine-seamable papermaker's fabric as claimed in claim 20 wherein said polymeric resin material is selected from the group consisting of polyamide, polyester, polyetherketone, polypropylene, polyaramid, polyolefin and polyethylene terephthalate (PET) resins.

22. An on-machine-seamable papermaker's fabric as claimed in claim 1 wherein said second CD yarns include monofilaments of non-circular cross section.

23. An on-machine-seamable papermaker's fabric as claimed in claim 1 wherein said system of third CD yarns are of a variety of yarn selected from the group consisting of monofilament yarns, multifilament yarns, and plied/twisted yarns in the form of plied monofilament or plied multifilament yarns.

24. An on-machine-seamable papermaker's fabric as claimed in claim 1 wherein said third CD yarns include filaments extruded from a polymeric resin material.

25. An on-machine-seamable papermaker's fabric as claimed in claim 24 wherein said polymeric resin material is selected from the group consisting of polyamide, polyester, polyetherketone, polypropylene, polyaramid, polyolefin and polyethylene terephthalate (PET) resins.

26. An on-machine-seamable papermaker's fabric as claimed in claim 1 wherein said third CD yarns include monofilaments of non-circular cross section.

27. An on-machine-seamable papermaker's fabric as claimed in claim 1 wherein said first CD yarns and said second CD yarns are of the same variety of yarn.

28. An on-machine-seamable papermaker's fabric as claimed in claim 1 wherein said first CD yarns and said third CD yarns are of the same variety of yarn.

29. An on-machine-seamable papermaker's fabric as claimed in claim 1 wherein said second CD yarns and said third CD yarns are of the same variety of yarn.

30. An on-machine-seamable papermaker's fabric as claimed in claim 1 wherein said first CD yarns and said second CD yarns are of different varieties of yarn.

31. An on-machine-seamable papermaker's fabric as claimed in claim 2 wherein said first CD yarns and said third CD yarns are of different varieties of yarn.

32. An on-machine-seamable papermaker's fabric as claimed in claim 1 wherein said second CD yarns and said third CD yarns are of different varieties of yarn.

33. An on-machine-seamable papermaker's fabric as claimed in claim 1 wherein said first CD yarns have a denier different from that of said second CD yarns.

34. An on-machine-seamable papermaker's fabric as claimed in claim 1 wherein said first CD yarns have a denier different from that of said third CD yarns.

35. An on-machine-seamable papermaker's fabric as claimed in claim 1 wherein said second CD yarns have a denier different from that of said third CD yarns.

36. An on-machine-seamable papermaker's fabric as claimed in claim 1 wherein said MD yarns interweave with said first CD yarns in said first weave pattern in a density different from that in which said MD yarns interweave with said second CD yarns in said second weave pattern.

37. An on-machine-seamable papermaker's fabric as claimed in claim 1 wherein said MD yarns interweave with said first CD yarns in said first weave pattern in a density different from that in which said MD yarns interweave with said third CD yarns in said third weave pattern.

38. An on-machine-seamable papermaker's fabric as claimed in claim 1 wherein said MD yarns interweave with said second CD yarns in said second weave pattern in a density different from that in which said MD yarns interweave with said third CD yarns in said third weave pattern.

39. An on-machine-seamable papermaker's fabric as claimed in claim 1 wherein the denier of said second CD yarns increases incrementally from the denier of said first CD yarns between said first CD yarns and said seaming loops.

40. An on-machine-seamable papermaker's fabric as claimed in claim 39 wherein the denier of adjacent pairs of said second CD yarns is the same.

41. An on-machine-seamable papermaker's fabric as claimed in claim 39 wherein the denier of said second CD yarns in each repeat of said second weave pattern is the same.

42. An on-machine-seamable papermaker's fabric as claimed in claim 1 wherein the denier of said second CD yarns decreases incrementally from the denier of said first CD yarns between said first CD yarns and said seaming loops.

43. An on-machine-seamable papermaker's fabric as claimed in claim 42 wherein the denier of adjacent pairs of said second CD yarns is the same.

44. An on-machine-seamable papermaker's fabric as claimed in claim 42 wherein the denier of said second CD yarns in each repeat of said second weave pattern is the same.

45. An on-machine-seamable papermaker's fabric as claimed in claim 1 wherein the denier of said third CD yarns increases incrementally from the denier of said first CD yarns between said first CD yarns and said seaming loops.

46. An on-machine-seamable papermaker's fabric as claimed in claim 45 wherein the denier of adjacent pairs of said third CD yarns is the same.

47. An on-machine-seamable papermaker's fabric as claimed in claim 45 wherein the denier of said third CD yarns in each repeat of said third weave pattern is the same.

48. An on-machine-seamable papermaker's fabric as claimed in claim 1 wherein the denier of said third CD yarns decreases incrementally from the denier of said first CD yarns between said first CD yarns and said seaming loops.

49. An on-machine-seamable papermaker's fabric as claimed in claim 48 wherein the denier of adjacent pairs of said third CD yarns is the same.

50. An on-machine-seamable papermaker's fabric as claimed in claim 48 wherein the denier of said third CD yarns in each repeat of said third weave pattern is the same.

51. An on-machine-seamable papermaker's fabric as claimed in claim 1 wherein the spacing between said second CD yarns increases incrementally from the spacing between said first CD yarns between said first CD yarns and said seaming loops.

52. An on-machine-seamable papermaker's fabric as claimed in claim 51 wherein the spacing between adjacent pairs of said second CD yarns is the same.

53. An on-machine-seamable papermaker's fabric as claimed in claim 51 wherein the spacing between said second CD yarns in each repeat of said second weave pattern is the same.

54. An on-machine-seamable papermaker's fabric as claimed in claim 1 wherein the spacing between said second CD yarns decreases incrementally from the spacing between said first CD yarns between said first CD yarns and said seaming loops.

55. An on-machine-seamable papermaker's fabric as claimed in claim 54 wherein the spacing between adjacent pairs of said second CD yarns is the same.

56. An on-machine-seamable papermaker's fabric as claimed in claim 54 wherein the spacing between said second CD yarns in each repeat of said second weave pattern is the same.

57. An on-machine-seamable papermaker's fabric as claimed in claim 1 wherein the spacing between said third CD yarns increases incrementally from the spacing between said first CD yarns between said first CD yarns and said seaming loops.

58. An on-machine-seamable papermaker's fabric as claimed in claim 57 wherein the spacing between adjacent pairs of said third CD yarns is the same.

59. An on-machine-seamable papermaker's fabric as claimed in claim 57 wherein the spacing between said third CD yarns in each repeat of said third weave pattern is the same.

60. An on-machine-seamable papermaker's fabric as claimed in claim 1 wherein the spacing between said third CD yarns decreases incrementally from the spacing between said first CD yarns between said first CD yarns and said seaming loops.

61. An on-machine-seamable papermaker's fabric as claimed in claim 60 wherein the spacing between adjacent pairs of said third CD yarns is the same.

62. An on-machine-seamable papermaker's fabric as claimed in claim 60 wherein the spacing between said third CD yarns in each repeat of said third weave pattern is the same.

* * * * *